US007463856B2

(12) United States Patent
Murase et al.

(10) Patent No.: US 7,463,856 B2
(45) Date of Patent: Dec. 9, 2008

(54) INTERMEDIATE TRANSFER BELT AND IMAGE FORMING APPARATUS

(75) Inventors: Koji Murase, Osaka (JP); Hidenori Takenaka, Osaka (JP); Shirika Saitoh, Osaka (JP); Tomoyuki Oda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 389 days.

(21) Appl. No.: 11/370,517

(22) Filed: Mar. 7, 2006

(65) Prior Publication Data

US 2006/0204289 A1 Sep. 14, 2006

(30) Foreign Application Priority Data

Mar. 8, 2005 (JP) ..... 2005-063540

(51) Int. Cl.
*G03G 15/01* (2006.01)

(52) U.S. Cl. ..... 399/302; 430/125.32

(58) Field of Classification Search ..... 399/299, 399/302, 308; 430/125.32; 347/115
See application file for complete search history.

(56) References Cited

U.S. PATENT DOCUMENTS 5,572,304 A * 11/1996 Seto et al. ..... 399/313
5,761,595 A * 6/1998 Tarnawskyj et al. ..... 399/308
5,832,351 A * 11/1998 Takekoshi et al. ..... 399/303
6,044,243 A * 3/2000 Hara ..... 399/302
6,101,360 A * 8/2000 Hara et al. ..... 399/308
6,834,176 B2 * 12/2004 Saito et al. ..... 399/302

FOREIGN PATENT DOCUMENTS

| | | | |
|---|---|---|---|
| CN | 101036087 A | | 9/2007 |
| JP | 09034269 A | * | 2/1997 |
| JP | 10-039642 | | 2/1998 |
| JP | 10268667 A | | 10/1998 |
| JP | 2004029769 A | * | 1/2004 |
| JP | 2004-101675 | | 4/2004 |

OTHER PUBLICATIONS

Chinese language office action and its partial English translation for corresponding Chinese application 200610058873.3 lists the references above.

* cited by examiner

*Primary Examiner*—Robert Beatty
(74) *Attorney, Agent, or Firm*—Hogan & Hartson LLP

(57) ABSTRACT

In the intermediate transfer belt of the present invention, a toner image formed on a plurality of photoreceptors is transferred and temporarily retained. The intermediate transfer belt comprises a reinforcing layer to reinforce the intermediate transfer belt and a surface protection layer that is stacked on the reinforcing layer through a middle layer and contacts the photoreceptors. The reinforcing layer and the surface protection layer have a larger value of surface resistance than a value of volume resistance of the whole belt. This makes it possible to prevent electric charge (voltage) from flowing out to rollers and image forming units and put proper electric charge (voltage) on the intermediate transfer belt. Preferably, the values of surface resistance of the reinforcing layer and the surface protection layer are $1\times10^{10}$ to $1\times10^{14}$ Ω/□ and the value of volume resistance of the whole intermediate transfer belt is less than $1\times10^{10}$ Ω·cm.

5 Claims, 3 Drawing Sheets

INTERMEDIATE TRANSFER BELT AND IMAGE FORMING APPARATUS

Priority is claimed to Japanese Patent Application No. 2005-063540 filed on Mar. 8, 2005, the disclosure of which is incorporated by reference in its entirety.

BACKGROUND OF THE INVENTION

1. Field of the Invention

The present invention relates to an intermediate transfer belt to form a toner image on a photoreceptor and transfer the toner image to a transfer medium, and an image forming apparatus using the same.

2. Description of Related Art

As a tandem-type color image forming apparatus, there exists a system where a toner image on a photoreceptor drum is superimposed onto an intermediate transfer belt and transferred to a transfer medium. In order to improve transferability to a transfer medium, an intermediate transfer belt that can handle surface irregularity of a transfer medium with its multilayer structure has been proposed as the intermediate transfer belt used for this system.

In an intermediate transfer belt as mentioned above, a reinforcing layer, a middle layer and a surface protection layer are stacked in order, and the reinforcing layer and the surface protection layer are formed on the surface of the intermediate transfer belt. In general, the reinforcing layer is made of a resin film such as polyimide (especially, toughened polyimide) and polyvinylidene-fluoride (PVDF). The middle layer is made of nitrile rubber (NBR), silicon, urethane or the like. The surface protection layer is coated with fluorine, Teflon (registered trademark) or the like.

Japanese Unexamined Patent Publication No. 10-39642 proposes a technique that defines the characteristics of a reinforcing layer and the strength characteristics of an elastic layer. Japanese Unexamined Patent Publication No. 2004-101675 proposes that when an intermediate transfer belt is stretched on a given roller in an image forming apparatus, a reinforcing layer contacting the roller has larger surface resistance than a value of volume resistance of the whole belt, thereby preventing applied current or applied voltage (hereinafter referring only to applied current) for transferring a toner image to an intermediate transfer belt from running into the roller.

Recently, an image forming apparatus has been required to be smaller and higher-speed. For this reason, in a tandem-type image forming apparatus, a plurality of image forming units are required to be disposed at a smaller interval.

However, when an interval between image forming units is made smaller to meet this requirement, the problem is that in the aforementioned conventional intermediate transfer belt, electric current applied to transfer a toner image to an intermediate transfer belt passes through the surface of the intermediate transfer belt to another image forming unit and therefore it is impossible to put proper electric charge (voltage) on the intermediate transfer belt.

SUMMARY OF THE INVENTION

The present invention is to provide an intermediate transfer belt that prevents electrification charge (current) for transferring a toner image to an intermediate transfer belt from flowing out to a roller on which an intermediate transfer belt is stretched and another neighboring image forming unit and that makes it possible to put proper electric charge (voltage), and an image forming apparatus using the same.

To solve the above problem, the present inventors have been dedicated to research and resulted in the present invention, finding the fact that by providing high surface resistance both to a reinforcing layer contacting a roller and a surface protection layer, it is possible to prevent electric charge (voltage) from flowing out to a roller and an image forming unit.

In the intermediate transfer belt of the present invention, a toner image formed on a plurality of photoreceptors is transferred and temporarily retained. The intermediate transfer belt comprises a reinforcing layer to reinforce the intermediate transfer belt and a surface protection layer that is stacked on the reinforcing layer through a middle layer and contacts the photoreceptors. The reinforcing layer and the surface protection layer have a larger value of surface resistance than a value of volume resistance of the whole belt.

The image forming apparatus of the present invention comprises a plurality of image forming units having a photoreceptor, an intermediate transfer belt wherein a toner image formed on a plurality of photoreceptors is transferred and temporarily retained, and a transfer section wherein the toner image on the photoreceptors that is formed on the intermediate transfer belt is transferred to a transfer medium. The image forming units are disposed along the moving direction of the intermediate transfer belt. The predefined intermediate transfer belt is provided as the intermediate transfer belt.

According to the present invention, the reinforcing layer constituting the surface of the intermediate transfer belt and the surface protection layer have a larger value of surface resistance than a value of volume resistance of the whole belt. Thus, high surface resistance in the reinforcing layer makes it possible to prevent electrification charge (current) applied for transferring a toner image to an intermediate transfer belt from running out into a roller on which an intermediate transfer belt is stretched, and high surface resistance in the surface protection layer makes it possible to prevent the electrification charge (current) from flowing out to another neighboring image forming unit. As a result, it becomes possible to put proper electrification charge (applied current) on the intermediate transfer belt. In addition, by adjusting a value of resistance in each layer of the intermediate transfer belt, transferability in the image forming apparatus can be made the most appropriate.

On top of this, in the present invention, since it is possible to prevent electrification charge (current) from running out into a roller on which an intermediate transfer belt is stretched and flowing out to an image forming unit, an image forming apparatus having excellent transferability can be obtained.

DETAILED DESCRIPTION OF PREFERRED EMBODIMENTS (Intermediate Transfer Belt)

Figure 1:
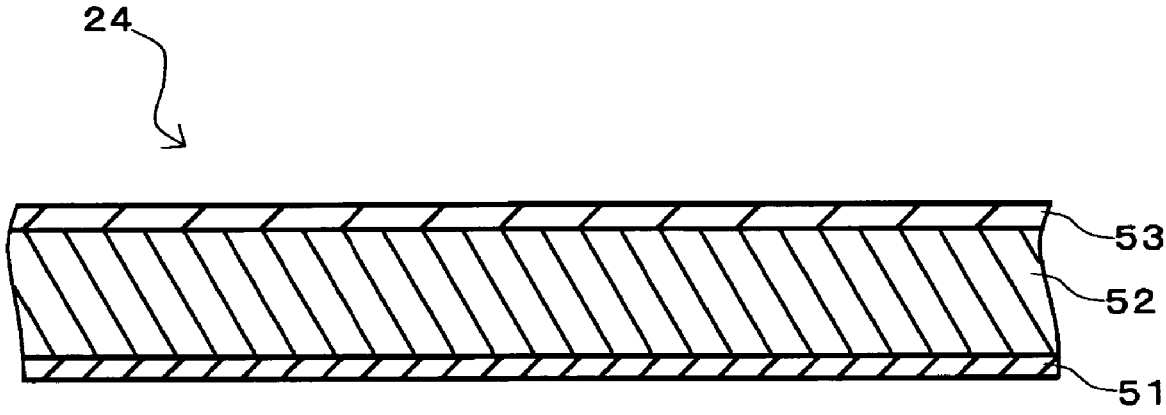
FIG. 1 is a schematic cross-sectional view showing one example of the intermediate transfer belt of the present invention.

The intermediate transfer belt of the present invention will be described with reference to the drawings. FIG. 1 is a cross-sectional view showing one example of the intermediate transfer belt of the present invention. As shown in FIG. 1, an intermediate transfer belt 24 comprises a reinforcing layer 51, a middle layer 52 and a surface protection layer 53. The surface protection layer 53 is stacked on the reinforcing layer 51 through the middle layer 52. In other words, the reinforcing layer 51 and the surface protection layer 53 form the surface of the intermediate transfer belt 24. In the intermediate transfer belt 24, a toner image formed on a plurality of photoreceptors is transferred and temporarily retained.

In the intermediate transfer belt 24, the reinforcing layer 51 has a larger value of surface resistance (Ω/□) than a value of volume resistance (Ω·cm) of the whole intermediate transfer belt 24. This makes it possible to prevent electrification charge (current) applied for transferring a toner image to an intermediate transfer belt from running out into a roller which contacts the reinforcing layer 51 and on which the intermediate transfer belt 24 is stretched. Moreover, in the intermediate transfer belt 24, the surface protection layer 53 has a larger value of surface resistance (Ω/□) than a value of volume resistance (Ω·cm) of the whole intermediate transfer belt 24. This makes it possible to prevent the electrification charge (current) from flowing out to an image forming unit.

Concretely, the values of surface resistance of the reinforcing layer 51 and the surface protection layer 53 may be $1\times10^{10}$ to $1\times10^{14}$ Ω/□, preferably, $1\times10^{12}$ to $1\times10^{14}$ Ω/□. In contrast, a larger value of surface resistance than $1\times10^{14}$ Ω/□ leads to lowered conductivity of transfer current in the direction of belt thickness. For this reason, in applying a predetermined transfer current, transfer voltage needs to be large and a power unit to send transfer current needs to have large capacity of power supply, which results in the problem of a larger power unit. Therefore, under normal conditions for transfer, a toner image formed on photoreceptors may not be transferred enough, or excessive transfer voltage may cause dielectric breakdown of photoreceptors. Also, a smaller value of surface resistance than $1\times10^{10}$ Ω/□ can cause such troubles as lowered transferability and a larger amount of toner remaining on the intermediate transfer belt 24.

The value of volume resistance of the whole intermediate transfer belt 24 may be less than $1\times10^{10}$, preferably, $4\times10^{8}$ to $6\times10^{9}$ Ω·cm. On the contrary, when the value of volume resistance is not less than $1\times10^{10}$, there can be such troubles as lowered transferability from photoreceptors to a transfer belt. When the value of volume resistance is less than $4\times10^{8}$, such troubles as image distortion can occur.

Particularly, in the present invention, it is preferable that the value of surface resistance of the reinforcing layer 51 is larger than that of the surface protection layer 53. This can make transferability more appropriate. Specifically, this relation is preferably maintained in the aforementioned range of the values of surface resistance of the reinforcing layer 51 and the surface protection layer 53.

The reinforcing layer 51 reinforces the intermediate transfer belt 24. The reinforcing layer 51 can be formed as a layer having a given value of surface resistance, by adding conductive material to insulating material as well as by changing the manufacturing conditions of the base material itself. Examples of the insulating material that can be used to form the reinforcing layer 51 include polyimide (especially, toughened polyimide) and polyvinylidene-fluoride (PVDF). Examples of the conductive material that can be used to form the reinforcing layer 51 include conductive carbon black. The reinforcing layer 51 may have a thickness of 0.05 to 0.2 mm, preferably, 0.05 to 0.1 mm.

Preferably, the middle layer 52 is an elastic layer. Specific examples of the middle layer 52 include nitrile rubber (NBR), polyurethane and silicon rubber. The middle layer 52 may have a thickness of 0.2 to 0.5 mm, preferably, 0.2 to 0.3 mm.

The middle layer 52 is formed as a layer having a given value of surface resistance by adding conductive material to the above insulating material. Examples of the conductive material that can be used to form the middle layer 52 include conductive carbon black. The middle layer 52 may have multilayer structure, for example, two-layer structure.

In the present invention, the value of volume resistance (Ω·cm) of the whole intermediate transfer belt 24 is set as smaller than the values of surface resistance (Ω/□) of the reinforcing layer 51 and the surface protection layer 53. For this purpose, by adjusting the value of volume resistance of the middle layer 52, the value of volume resistance of the whole intermediate transfer belt 24 may be adjusted. For example, an increase in the amount of carbon of the middle layer 52 can make smaller both the value of volume resistance of the middle layer 52 and the value of volume resistance of the whole intermediate transfer belt 24.

The surface protection layer 53 contacts photoreceptors and a layer composed of fluorine, Teflon (registered trademark) or the like can be used. The value of surface resistance of the surface protection layer 53 can be adjusted by the amount of added conductive carbon black that is conductive material, layer thickness and the like. The surface protection layer 53 preferably has a thickness of 0.003 to 0.01 mm.

The values of surface resistance (Ω/□) in the reinforcing layer 51 and the surface protection layer 53 can be measured according to JIS K6911, for example, using a resistance meter (product name "Hiresta IP" manufactured by Mitsubishi Chemical Corp.) and an electrode (product name "HR-100" manufactured by Mitsubishi Chemical Corp.). The value of volume resistance (Ω·cm) of the whole intermediate transfer belt 24 can also be measured with the above resistance meter and electrode.

(Manufacturing Method of Intermediate Transfer Belt)

The method of manufacturing the intermediate transfer belt 24 is not specially limited. For example, the intermediate transfer belt 24 can be manufactured by reacting and hardening liquid material and forming multilayer structure. Specifically, it can be manufactured with a heretofore known centrifugal molding device.

(Image Forming Apparatus)

Next, the image forming apparatus of the present invention will be described. The image forming apparatus of the present invention comprises a plurality of image forming units having a photoreceptor, an intermediate transfer belt wherein a toner image formed on a plurality of photoreceptors is transferred and temporarily retained, and a transfer section wherein the toner image on the photoreceptors that is formed on the intermediate transfer belt is transferred to a transfer medium. The image forming units are disposed along the moving direction of the intermediate transfer belt. The aforementioned intermediate transfer belt 24 is provided as the intermediate transfer belt.

Figure 2:
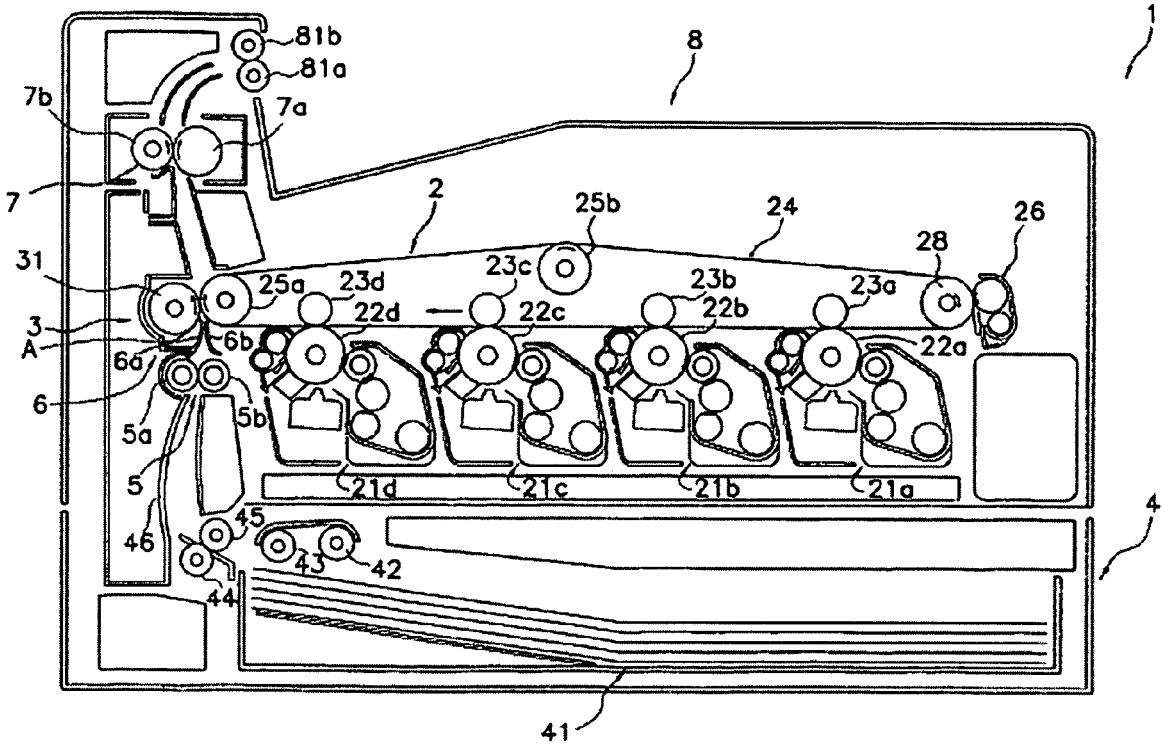
FIG. 2 is a pattern diagram showing one example of the image forming apparatus of the present invention.

One example of the above image forming apparatus of the present invention will be described in detail, referring to the drawings. FIG. 2 shows one example of the image forming apparatus of the present invention, that is, the structure of main part of a tandem-type color printer.

As shown in FIG. 2, the tandem-type color printer 1 comprises an image forming section 2 to form a color image, a transfer section 3 to transfer a toner image formed in the image forming section 2 to a transfer medium, a paper feed section 4 to supply the transfer medium, a resist roller section 5 to synchronize the transport of the transfer medium and image forming, a transfer medium transport guiding mechanism 6 to guide the transfer medium that arrives at the resist roller section 5 to the transfer position, a fixing section 7 to fix the toner image transferred to the transfer medium and a paper ejection section 8 to eject the transfer medium.

The image forming section 2 is located at the approximate center of the color printer 1 and comprises four image forming units 21*a*, 21*b*, 21*c* and 21*d*, first transfer rollers 23*a*, 23*b*, 23*c* and 23*d*, and the intermediate transfer belt 24. The image forming units 21*a*, 21*b*, 21*c* and 21*d* have photoreceptor drums 22*a*, 22*b*, 22*c* and 22*d* on the surface of which electrostatic latent images are respectively formed, corresponding to four colors of black, yellow, cyan and magenta. The first transfer rollers 23*a*, 23*b*, 23*c* and 23*d* are disposed opposite to the photoreceptor drums 22*a* to 22*d*, and transfer a toner image formed on the surface of the photoreceptor drums. As development method, contact development method wherein a developer layer is in contact with a photoreceptor drum or toner projection development method wherein the both are not in contact may be employed. In addition, liquid development method may be employed.

Figure 3:
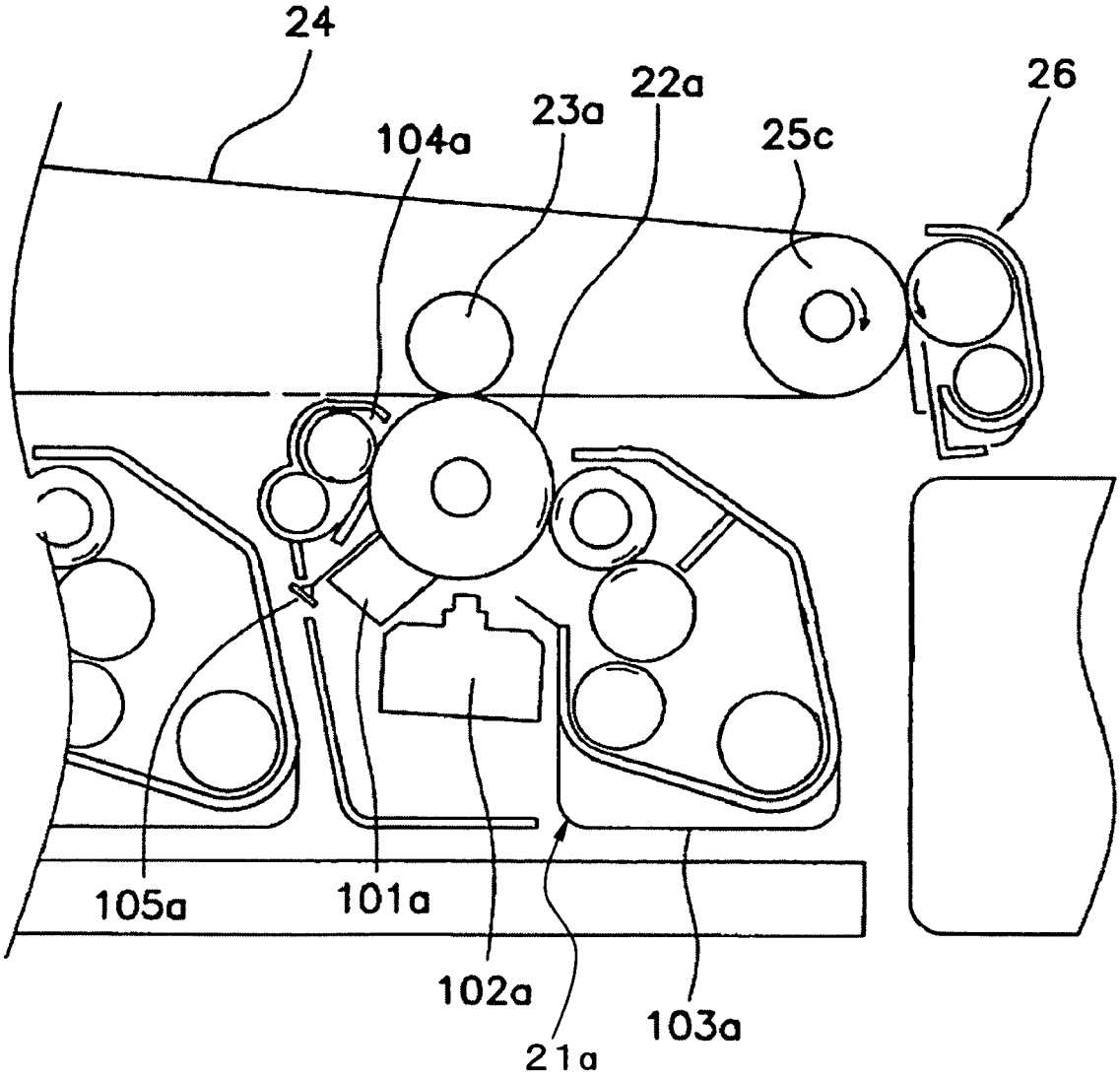
FIG. 3 is a pattern diagram closely showing an image forming unit of the image forming apparatus in FIG. 2.

Since the four image forming units 21*a* to 21*d* corresponding to four colors of black, yellow, cyan and magenta have the same internal structure, the black image forming unit 21*a* is taken as an example and its structure will be described. As shown in FIG. 3, a charging device 101*a*, an exposing device 102*a*, a developing device 103*a*, a cleaning device 104*a* and an electricity removal device 105*a* are disposed around the photoreceptor drum 22*a* of the black image forming unit 21*a*. In the image forming unit 21*a*, a toner image is formed based on image data, as described below.

In the transfer section 3, a second transfer roller 31 contacts the intermediate transfer belt 24. With second transfer bias applied to the second transfer roller 31, a full-color toner image formed on the intermediate transfer belt 24 is transferred to paper (transfer medium).

The paper feed section 4 is provided below the image forming section 2 and comprises a cassette 41 to store paper, pick-up rollers 42 and 43 to pick up the stored paper, and a pair of paper feed rollers 44 and 45 to send sheets of paper one by one to a transport path. The paper transported from the paper feed section 4 is transported through a vertical transport path 46 to the transfer position. A pair of resist rollers 5*a* and 5*b* is provided on the downstream side in the transport direction of the vertical transport path 46. The pair of resist rollers 5*a* and 5*b* keeps ready the paper that is transported from the paper feed section 4, and sends it to the transfer position A while synchronizing image forming in the intermediate transfer belt 24.

The fixing section 7 is provided above the transfer section 3 to melt and fix a toner transferred on the paper. The fixing section 7 has a heating roller 7*a* with a built-in heater and a pressure roller 7*b* pressed against the heating roller 7*a*. The paper is interposed and transported between the both rollers, and the toner image transferred on the surface of the paper is fixed by heat. Ejection rollers 81*a* and 81*b* are provided above the fixing section 7. The paper having a toner image formed is ejected through the ejection rollers 81*a* and 81*b* onto the paper ejection section 8 that is provided in the uppermost part of the color printer 1.

As shown in FIG. 2, the intermediate transfer belt 24 is disposed on the photoreceptor drums 22*a* to 22*d*. Stretched between a driving roller 25*a* rotated by a driving means such as a motor that is not shown in the drawings and a driven roller 28 disposed away from the driving roller 25*a*, the intermediate transfer belt 24 is driven and circulated. In addition, a tension roller 25*b* is provided between the driving roller 25*a* and the driven roller 28. The tension roller 25*b* maintains the tension of the intermediate transfer belt 24 through tension adjusting mechanism that is not shown in the drawings.

The first transfer rollers 23*a* to 23*d* are forced through the intermediate transfer belt 24 so as to be respectively pressed against the photoreceptor drums 22*a* to 22*d*. With this force, the intermediate transfer belt 24 is pressed against the photoreceptor drums 22*a* to 22*d*. Moreover, an intermediate transfer cleaning device 26 is provided opposite to the driven roller 28 to clean the toner adhering to the intermediate transfer belt 24 and the like.

In the color printer 1, the reinforcing layer 51 of the intermediate transfer belt 24 is contact with the driving roller 25*a*, the driven roller 28, the tension roller 25*b* and the first transfer rollers 23*a* to 23*d*. As described above, in the present invention, the value of surface resistance (Ω/□) of the reinforcing layer 51 is larger than the value of volume resistance (Ω·cm) of the whole intermediate transfer belt 24, specifically, $1\times10^{10}$ to $1\times10^{14}$ Ω/□. Therefore, it is possible to prevent electrification charge (current) applied to transfer a toner image to the intermediate transfer belt 24 from running out into the driving roller 25*a*, the driven roller 28, the tension roller 25*b* and the first transfer rollers 23*a* to 23*d*.

The color printer 1 has four image forming units 21*a* to 21*d*, but an interval between these image forming units is small. Concretely, the intervals between the image forming units 21*a* and 21*b*, 21*b* and 21*c*, and 21*c* and 21*d* are 8 to 12 cm in the color printer 1. In the present invention, as described above, even if the interval between these image forming units is small, the value of surface resistance (Ω/□) of the surface protection layer 53 of the intermediate transfer belt 24 is larger than the value of volume resistance (Ω·cm) of the whole intermediate transfer belt 24, specifically, $1\times10^{10}$ to $1\times10^{14}$ Ω/□. Therefore, it is possible to prevent the electrification charge (current) from flowing out to the image forming units 21*a* to 21*d* and put proper electric charge (applied voltage) on the intermediate transfer belt 24. As a result, by adjusting a value of resistance in each layer of the intermediate transfer belt 24, transferability in the color printer 1 can be made the most appropriate.

Next, the image forming operation of the color printer 1 will be described. First, after turning on the color printer 1, various parameters are initialized and initial settings such as the temperature setting of the fixing section 7 are configured. Then, an image data input section that is not shown in the drawings receives image data from a personal computer connected by networking etc. The image data received here is sent to the image forming section 2.

In the image forming units 21*a* to 21*d* of the image forming section 2, a toner image is formed based on the image data so received. Taking the black image forming unit 21*a* as an example, image forming operation will be described here. First, the photoreceptor drum 22*a* is charged by the charging device 101*a*, and exposure is carried out by the exposing device 102*a*, corresponding to black image data. Then, an electrostatic latent image corresponding to black image data is formed on the surface of the photoreceptor drum 22*a*. The electrostatic latent image is made a toner image in the black developing device 103*a* and transferred to the intermediate transfer belt 24 by transfer bias (constant current control) applied to the first transfer roller 23*a*. The residual developer remaining on the photoreceptor drum 22*a* is cleaned by the cleaning device 104*a* and thrown into a waste toner container that is not shown in the drawings. In addition, the electricity removal device 105*a* removes the residual charge of the photoreceptor drum 22*a*. Regarding the other colors as well, this operation is performed in the magenta image forming unit 21*b*, the cyan image forming unit 21*c* and the yellow image forming unit 21*d* to form a full-color toner image on the intermediate transfer belt 24.

At the same time, in the paper feed section 4, paper is picked up from the paper feed cassette 41 with the pick-up rollers 42 and 43 and sent through the pair of paper feed rollers 44 and 45 to the vertical transport path 46. Subsequently, the paper is transported from the pair of resist rollers 5*a* and 5*b* at the same timing as image forming on the intermediate transfer belt 24 and guided to the transfer section 3 by the transfer medium transport guiding mechanism 6. In the transfer section 3, the second transfer roller 31 contacts the intermediate transfer belt 24. With second transfer bias applied to the second transfer roller 31, a full-color toner image formed on the intermediate transfer belt 24 is transferred to the paper. The full-color toner image transferred to the paper is fixed on the paper by heat and pressure in the fixing section 7, and the paper having the full-color toner image formed is ejected onto the paper ejection section 8. The residual toner on the intermediate transfer belt 24 is cleaned by the intermediate transfer cleaning device 26 and thrown into a waste toner container that is not shown in the drawings.

In this image forming process, when the driving roller 25*a* is driven and rotated by a driving device that is not shown in the drawings, the intermediate transfer belt 24 starts to operate. The paper is transported from the pair of resist rollers 5*a* and 5*b* at the same timing as image forming on the intermediate transfer belt 24 and then transported to a nip portion between the second transfer roller 31 and the intermediate transfer belt 24. The second transfer roller 31 is pressed against the intermediate transfer belt 24 side. Furthermore, the intermediate transfer belt 24 is put around the driving roller 25*a*. That means the second transfer roller 31 is pressed against the driving roller 25*a* through the intermediate transfer belt 24.

In the transfer section 3, when the paper arrives at the transfer nip portion, the second transfer roller 31 presses the paper. The paper contacts the toner image on the intermediate transfer belt 24 and the toner image on the intermediate transfer belt 24 is transferred to the paper.

As a developer in the present invention, a one-component developer composed of a non-magnetic toner or a two-component developer composed of a non-magnetic toner and a magnetic carrier (e.g. iron powder or ferrite) can be used. Regardless of a one-component developer and a two-component developer, the volume average particle size of the toner may be 3 to 10 μm, preferably, 4 to 7 μm. The toner is composed at least of a binder resin and a coloring agent and if necessary, an inorganic oxide is externally added thereto as an abrasive.

The type of binder resin is not specially limited and exemplified by thermoplastic resin such as polystyrene resin, acrylic resin, styrene-acrylic copolymer, polyethylene resin, polypropylene resin, polyvinyl chloride resin, polyester resin, polyamide resin, polyurethane resin, polyvinyl alcohol resin, vinyl ether resin, N-vinyl resin and styrene-butadiene resin. In addition to thermoplastic resin, thermoset resin can be partly used as a binder resin. The thermoset resin is exemplified by epoxy resin or cyanate resin.

Examples of the coloring agent that can be used include carbon black such as acetylene black, lamp black and aniline black as black pigment; chrome yellow, zinc yellow, cadmium yellow, iron oxide yellow, mineral fast yellow, nickel titanium yellow, Naples yellow, naphthol yellow S, Hansa yellow G, Hansa yellow 10G, benzidine yellow G, benzidine yellow GR, quinoline yellow lake, permanent yellow NCG and tartrazine lake as yellow pigment; red chrome yellow, molybdenum orange, permanent orange GTR, pyrazolone orange, Vulcan orange, indanthrene brilliant orange RK, benzidine orange G and indanthrene brilliant orange GK as orange pigment; bengala, cadmium red, red lead, cadmium mercury sulfide, permanent red 4R, lithol red, pyrazolone red, watching red calucium salt, lake red D, brilliant carmine 6B, eosin lake, rhodamine lake B, alizarin lake and brilliant carmine 3B as red pigment; manganese violet, fast violet B and methyl violet lake as violet pigment; iron blue, cobalt blue, alkali blue lake, victoria blue lake, phthalocyanine blue, metal-free phthalocyanine blue, partially chlorinated products of phthalocyanine blue, fast sky blue and indanthrene blue BC as blue pigment; chrome green, chrome oxide, pigment green B, malachite green lake and fanal yellow green G as green pigment; and zinc flower, titanium oxide, antimony white, zinc sulfide, barytes, barium carbonate, clay, silica, white carbon, talc and alumina white as white pigment. It is preferable to use 2 to 20 parts by weight, particularly, 5 to 15 parts by weight of the coloring agent to 100 parts by weight of the binder resin.

An inorganic oxide such as alumina, titanium oxide, zinc oxide and magnesium oxide may be added to the toner as an external additive. The external additive may have a volume average particle size of 0.02 to 1.0 μm, preferably, 0.1 to 0.3 μm.

Examples of the present invention will be described below. It is understood, however, that the examples are for the purpose of illustration and the invention is not to be regarded as limited to any of the specific materials or condition therein.

EXAMPLES

Examples 1 to 3 and Comparative Example 1

(Manufacturing of Intermediate Transfer Belt)

An intermediate transfer belt comprising a reinforcing layer, a middle layer and a surface protection layer was manufactured, using a centrifugal molding device. Specifically, the reinforcing layer was made of PVDF and 0.1 mm thick. The middle layer was single-layered, made of NBR and the amount of carbon black shown in Table 1 and 0.3 mm thick. The surface protection layer was made of fluorine resin, 0.01 mm thick and had the amount of carbon black shown in Table 1 added. Table 1 shows the weight of added carbon black (% by weight) to the total weight of each layer.

TABLE 1

| | Amount of carbon black (% by weight) | | | |
|---|---|---|---|---|
| | Example 1 | Example 2 | Example 3 | Comp. Ex. 1 |
| Reinforcing layer | 0% | 0% | 0% | 0% |
| Middle layer | 8% | 10% | 15% | 0.5% |
| Surface protection layer | 0% | 0% | 1% | 0.3% |

Regarding each intermediate transfer belt so manufactured, the values of surface resistance (Ω/□) of the reinforcing layer and the surface protection layer and the value of volume resistance (Ω·cm) of the whole intermediate transfer belt were measured at an applied voltage of 250V according to JIS K6911, using a resistance meter (product name "Hiresta IP" manufactured by Mitsubishi Chemical Corp.) and an electrode (product name "HR-100" manufactured by Mitsubishi Chemical Corp.). The results are presented in Table 2.

TABLE 2

| Belt characteristics | Example 1 | Example 2 | Example 3 | Comp. Ex. 1 |
|---|---|---|---|---|
| Value of surface resistance of reinforcing layer pS(Ω/□) | $8.2 \times 10^{10}$ | $1.2 \times 10^{10}$ | $1.0 \times 10^{10}$ | $3.9 \times 10^{8}$ |
| Value of surface resistance of surface protection layer pS(Ω/□) | $2.1 \times 10^{10}$ | $3.3 \times 10^{11}$ | $4.9 \times 10^{10}$ | $4.0 \times 10^{9}$ |
| Value of volume resistance of the whole belt pV (Ω · cm) | $5.8 \times 10^{9}$ | $4.5 \times 10^{8}$ | $1.6 \times 10^{9}$ | $4.1 \times 10^{8}$ |

(Evaluation Test on Transferability)

Putting the above intermediate transfer belt on a tandem-type color printer, evaluation test was conducted on transferability. The tandem-type color printer is a prototype and the conditions of the color printer are as follows.

Development method: liquid development method

Interval between image forming units: 9.4 cm

Print speed: 26 cpm

Linear speed (drum circumferential speed): 116 mm/second

Drum diameter: ϕ40 mm

Surface potential: 550V

Developing bias: 400V

First transfer bias (constant voltage control): 300V

Second transfer bias (constant voltage control): 20 μA

The test was conducted by measuring the weight of toner on the belt. Transferability (%) was found out by measuring the amount of toner remaining on the belt after transfer to paper and calculating the amount of transferred toner. The results are shown in Table 3.

TABLE 3

| | Example 1 | Example 2 | Example 3 | Comp. Ex. 1 |
|---|---|---|---|---|
| Transferability (%) | 97.6% | 91% | 90% | 85% |
| Evaluation | Good transferability, a little toner remaining on the intermediate transfer belt | Good transferability, a little toner remaining on the intermediate transfer belt | Good transferability, a little toner remaining on the intermediate transfer belt | Lower transferability than Examples 1 to 3, much toner remaining on the intermediate transfer belt |

As shown in Table 3, Examples 1 to 3 showed high transferability and obtained a good result. In particular, Example 1 showed a very high transferability of 97.6%. On the other hand, Comparative Example 1 had a transferability of less than 90%, which was not a good result.

In Examples 1 to 3, the values of surface resistance (Ω/□) of the reinforcing layer and the surface protection layer were made larger than the value of volume resistance (Ω·cm) of the whole intermediate transfer belt. This made it possible to prevent electric charge (voltage) from flowing out to the rollers on which the intermediate transfer belt was stretched and the image forming units contacting the intermediate transfer belt and put proper electric charge (voltage) on the intermediate transfer belt. This is possibly the reason why Examples 1 to 3 obtained a good result.

By contrast, in Comparative Example 1, the values of surface resistance (Ω/□) of the reinforcing layer and the surface protection layer were made smaller than the value of volume resistance (Ω·cm) of the whole intermediate transfer belt. Therefore, electric charge (voltage) flowed out to the rollers on which the intermediate transfer belt was stretched and the image forming units contacting the intermediate transfer belt, and proper electric charge (voltage) could not be put on the intermediate transfer belt. This is possibly the reason why Comparative Example 1 could not obtain a good result.

It is further understood by those skilled in the art that the foregoing description is a preferred embodiment of the disclosed intermediate transfer belt and image forming apparatus and that various changes and modifications may be made in the invention without departing from the spirit and scope thereof.

What is claimed is:

1. An intermediate transfer belt, wherein a toner image formed on a plurality of photoreceptors is transferred and temporarily retained, comprising a reinforcing layer to reinforce the intermediate transfer belt and a surface protection layer that is stacked on the reinforcing layer through a middle layer and contacts the photoreceptors:

the reinforcing layer and the surface protection layer have a larger value of surface resistance than a value of volume resistance of the whole belt; and the value of surface resistance of the reinforcing layer is larger than the value of surface resistance of the surface protection layer.

2. The intermediate transfer belt according to claim 1, wherein the values of surface resistance of the reinforcing layer and the surface protection layer are 1×1010 to 1×1014 Ω/□ and the value of volume resistance of the whole belt is less than 1×1010 Ω·cm.

3. The intermediate transfer belt according to claim 1,wherein the reinforcing layer has a thickness of 0.05 to 0.2 mm, the middle layer has a thickness of 0.2 to 0.5 mm and the surface protection layer has a thickness of 0.003 to 0.01 mm.

4. An image forming apparatus, comprising:

a plurality of image forming units having a photoreceptor;

an intermediate transfer belt wherein a toner image formed on a plurality of photoreceptors is transferred and temporarily retained; and a transfer section wherein the toner image on the photoreceptors that is formed on the intermediate transfer belt is transferred to a transfer medium, wherein the image forming units are disposed along the moving direction of the intermediate transfer belt; and the intermediate transfer belt according to claim 1 is provided as the intermediate transfer belt.

5. The image forming apparatus according to claim 4, wherein an interval between the image forming units is 8 to 12 cm.

* * * * *